US006575532B2

(12) United States Patent
Almerico

(10) Patent No.: US 6,575,532 B2
(45) Date of Patent: Jun. 10, 2003

(54) BEACH CHAIR HAVING A SWIVELABLE MEANS

(76) Inventor: Richard A. Almerico, 15021 Lake Maurine Dr., Odessa, FL (US) 33556

( * ) Notice: Subject to any disclaimer, the term of this patent is extended or adjusted under 35 U.S.C. 154(b) by 0 days.

(21) Appl. No.: 09/877,373

(22) Filed: Jun. 11, 2001

(65) Prior Publication Data

US 2002/0185902 A1 Dec. 12, 2002

(51) Int. Cl.[7] ..... A47C 1/02
(52) U.S. Cl. ..... 297/344.26; 297/359
(58) Field of Search ..... 297/452.2, 344.26, 297/344.21, 359, 440.11, 452.56

(56) References Cited

U.S. PATENT DOCUMENTS 4,076,347 A 2/1978 Meek
4,482,186 A 11/1984 Gomes
4,630,332 A 12/1986 Bisbing
4,824,170 A * 4/1989 Goldmeier
4,842,335 A 6/1989 Wunderlich
5,039,164 A * 8/1991 Gibbs
5,360,258 A * 11/1994 Alivizatos
5,395,157 A * 3/1995 Rollo et al.
5,580,129 A * 12/1996 Findlay
5,678,890 A * 10/1997 Tenbroeck
5,692,800 A * 12/1997 Perin
6,082,820 A * 7/2000 Jeng

OTHER PUBLICATIONS

Web Page www.Suntracker.com, RBF Company, 790 Grove St., Glencoe, IL 60022.

* cited by examiner

*Primary Examiner*—Milton Nelson, Jr.
(74) *Attorney, Agent, or Firm*—F. Rhett Brockington

(57) ABSTRACT

A swivelable beach chair having excellent corrosion resistance, where the chair has a PVC tubing frame, which supports a flexible fabric covering that forms the seat and the back; has a PVC tubing underpinning that supports the seat; has a planar bearing that has a pair of self aligning plastic disks; and has a base, which is a PVC tubing ring assembly having spoke like components that radiate from the bottom disk of the planar bearing. The beach chair also, optionally, has arm rests with a recline feature for adjusting the angle of the back. The hinge connecting the back to the seat is also comprised of PVC tubing.

12 Claims, 6 Drawing Sheets

BEACH CHAIR HAVING A SWIVELABLE MEANS

BACKGROUND OF THE INVENTION

The invention relates generally to swivelable chairs, and more particularly to a swivelable chair that has excellent resistance to corrosion and fouling, even under the harshest environmental conditions.

The invention is a swivelable chair that can function and resist deterioration even under the harshest outdoor conditions. These harsh conditions are most easily identified with the beach, because not only are these aging and oxidative issues associated with sunlight, but also the effects of saltwater, saltwater filled air, wind and sand. The situation is particularly aggravating for moving part components, because even materials that exhibit good resistance to oxidation, are often effected by abrasion. A good example of a corrosion resistant metal is aluminum. Aluminum is effected very little by the beach environ, however in applications where there is surface against surface movement, as in the case of a hinge, the aluminum hinge generates fine black dust filings as the two aluminum surfaces slide across each other. The salt in saltwater forms crystalline deposits as the water dries, leaving behind a very hard substance, which acts as an abrasive against the aluminum. Also, when aluminum is in contact with other metals, it generates strong electromotive forces (like in batteries) which can accelerate the destruction of the other metal. Saltwater and sand are particularly corrosive to bearings on beach chairs. Wunderlich, in U.S. Pat. No. 4,842,335, discloses a beach chair having a PVC frame, where the seat swivels on a planar bearing. While the bearing is protected pretty well from sand, the bearing does not have an air tight seal, and minute salt deposits can rapidly form in the presence of a sea mist. Additionally, and even more corrosive, saltwater can cause the metal bearing to rapidly rust. Even bearings packed in grease will rust unless repacked on a regular cycle. To the user of a chair, the grease can be as troublesome as the black filings or the rust.

What is needed is a chair that that doesn't have any hinges that can rust or generate black filings or become packed with sand or exude grease. Furthermore, what is desired is a chair that is light enough that it can be easily carried. Additional requirements include a chair that can swivel, where the swivel is virtually maintenance free, unaffected by a saltwater environment, and where the swivel does not unduly add to the overall cost or weight of the chair. Of course, the swivel should not exude grease or generate black filings, and should perform even when encrusted by sand and salt.

A beach chair must have a base with sufficient surface area to prevent the chair from sinking into the sand. The Wunderlich's U.S. Pat. No. 4,842,335 discloses an elegant solution this problem. In lieu of traditional legs, the chair rests on a ring, that, like the chair, is constructed of PVC tubing. The circular base is a very stable platform, which is needed to swivel smoothly.

Gomes' U.S. Pat. No. 4,482,186 addresses the issue of devising a hinge that does not generate black filings as the hinge is worked open and closed. The moving components of the frame are separated by plastic washer to keep the surfaces from rubbing against each other. The chairs disclosed by both Gomes and Wunderlich have a frame with a fabric stretched across the frame. The fabric is not secured from sideways movement except at the top of the back and the front of the seat.

Meek describes a method for making an "Antifriction Nylon Member" in U.S. Pat. No. 4,076,347. His patent discloses how Nylon® can be compounded with lubricants to make the Nylon® self-lubricating. The anticipated application for the compounded Nylon® is as a component in the fabrication of axial bearings.

A non-squeaky hinge is disclosed by Bishing in U.S. Pat. No. 4,630,332. The knuckles of the hinge are made of acetal, a hard plastic, and the pin is made of Nylon, a more elastic plastic. The hinge is resistant to aging and would not generate black filings.

The RBF company offers a beach chair, trademarked the Suntracker®, that like Wunderlich's chair, also has a planar bearing. RBF's Suntracker addresses the sand issue by enclosing the ball bearings in a polyethylene ring. The metal plate housing the planar bearing is constructed of zinc coated steel. These prophylactic measures, no doubt would appear to slow down corrosion, however marine fittings, particularly running rigging, generally employ type 316 stainless steel. The addition of zinc would slow down air oxidation, but would create greater electrical anisotropy between metals of differing electrical potential, which could aggravate in situ oxidation. Also, like Wunderlick's chair, the preferred base is a ring.

SUMMARY OF THE INVENTION

The invention is a chair having excellent resistance to the corrosive and abrasive elements of a saltwater beach. Furthermore, the invention is a chair that has a stable platform on soft sand, and is of sufficient resistance to sand and surf that it can be used in shallow waters. The chair is swivelable, allowing the user to change his angular orientation without leaving the chair, by simply applying a tangential force with an arm or leg. In a preferred embodiment the angle of incline of the chair back is adjustable, such that the user can reversibly adjust his support from a posture of sitting to reclined.

The chair consists of a seat, an underpinning—which is fastened to and supports the seat, a swivelable means—which is fastened to and supports the underpinning, and a base—which is fastened to and supports the swivelable means.

The seat is the uppermost horizontal portion of the chair. The seat is a shelf, a shelf with a cushion, or preferably a frame with a flexible covering. The frame is preferably constructed of sectional elements of tubing that are connected with coupling elements to form the desired shape. The preferred shape of the frame is substantially rectangular. The sectional elements are substantially straight. The coupling elements are used to extend or corner two sectional elements, and a split coupling element is used to join two sectional elements to a third. Examples of split coupling elements are a T and a Y coupling element. The frame of the seat has a rear sectional element, a front sectional element, a right sectional element and a left sectional element. The flexible covering is preferably a cloth or a webbing or a combination thereof. The flexible covering is preferably selected from materials known to have good resistance to sunlight. Polyesters, acrylics and polyamides, such as Nylon® are well known in the art. Kevlar®, a polyimide and Fiberglas® are also recognized as having good resistance to sunlight, Blends of any of the above are also anticipated. Less preferable, but less expensive synthetic materials, like polyvinyl materials such as polyethylene, plasticized polyvinylchloride and polypropylene will also work, as will natural fibers such as cotton.

The frame is preferably constructed of pvc tubing, however aluminum tubing will also work.

The chair can optionally, be fitted with a back preferably of similar construction to the seat. The flexible covering is attached to the seat frame and the back frame.

The chair can also have armrests, wherein it is preferred that the top most surface of armrest is comprised of wood.

The chair can optionally have an adjustable recline feature, which enables the back to be reversibly adjusted backward. This feature is comprised of an apparatus for setting the angle of recline, and a hinge assembly that enables the back to pivot on the rear sectional element. The angle is set using a notched slide on the underside of the right and left armrest. This is a conventional adjustable recline apparatus for chaise beach recliners. The hinge assembly is novel. The left and right ends of the rear sectional element are fitted with a T-shaped coupling element and held together with an interior tie bar. The T-shaped split couplings are then fastened to the ends of the tubing comprising the side elements of the back frame. The combination of sectional elements and coupling elements forms a left hinge and a right hinge having no metal parts. The novel hinge has no metal parts, and it is substantially free of any openings where sand can collect.

The underpinning is an assembly for attaching the seat to the swivelable means. The underpinning provides the support for the seat, and translates the stress weight of the chair's occupant to the swivelable means. Like the seat, the preferred structure is a tubular frame of pvc. Typically, the seat is supported via left and the right sectional elements at either one or two points per element. Alternatively, the left and the right sectional elements and the rear sectional element can be supported at one point per element. Additional support is generally not needed. The underpinning consists of one or more heavy gauge sectional element and the corresponding requist number of split coupling elements. The heavy gauge sectional element is fastened to the top of the swivelable means and bends upward with a U shape, where it is connected to the split coupling element. The split coupling element is spliced into the receiving sectional element of the frame.

The swivelable means is a unique planar bearing, where the planar bearing consists of a pair of superimposed horizontal disks which are fastened together with an axial longitudinal pin. There are no ball bearings, or other moving elements between the disks. There are no sealing rings. The disks have a flush fit. The pair of disks consists of an upper disk and a lower disk. The upper disk has a bottom, overcut face with a low friction first surface and a top face that is fitted with hardware for mounting the heavy gauge sectional element of the underpinning. The lower disk has an upper, undercut face that has a low friction second surface and a sectional portion that is equipped for mounting the base.

The overcut face on the upper disk is axially aligned with the undercut face of the bottom disk, and positioned face-to-face, such that the overcut face matches and the undercut face. The disks are essentially nested, and therein self-aligning.

It should be noted that the stress weight is spread over the interface face of the superimposed disks, and therefore the frictional resistance between the disks is relatively low. The disks are substantially constructed of an engineering plastic, where a preferred plastic is self-lubricating plastic. The utilization of a self lubricating plastic, such as Nylon® or Nylon® compounded with a lubricant further reduces the frictional resistance. It is anticipated that a variety of plastics will be of sufficiently low resistance to fulfill the frictional resistance criterion. The reader is reminded that in the instant invention, under normal operating conditions there will be very little rotation, as contrasted to the operation of most bearings (i.e. a machine turning an axle). Heat build up as a consequence of friction resistance therefore is not a problem.

The base is integral with the lower disk, and a preferred construction is a spoke-ring assembly, where a sectional element of tubing radially emanates from a snug fitting receiving hole in the lower disk. The holes are equidistantly positioned around the bottom disk. The sectional elements, usually four, are orthogonal, and each is capped with T-shaped coupling element. The coupling element is connected to a pair of two curved sectional elements. The connected curved coupling elements form a ring. The ring holds the sectional elements in the bottom disk in position, and therefore a fastening means for the bottom disk is not required. This arrangement of elements facilitates in the manufacturing process, without any loss of performance. A preferred bottom disk is formed with four identical holes that are orthogonal from each other. The base prevents the chair from sinking into soft sand. A 1 inch wide ring that is 18 inches in diameter has a surface area that is approximately 18 times the surface area of 4 legs that are 1 inch in diameter. The additional surface area stabilizes the chair when it is swiveled, and enables the base of the chair to span irregular contours in the sand.

Recapping, the instant invention is a beach chair with a swivelable means. The swivelable means is a planar bearing that is uniquely suitable for the application because the disks are self-centering, the planar bearing has no ball bearings, the surfaces are self lubricating, and nearly the entire planar bearing is constructed of plastic. The preferred plastic is selected for excellent aging properties in a saltwater environment and its slip properties. The superimposition of disks, such that they are aligned with the weight stress, which in this case is the seat and its occupant, optimally distributes the stress across the interface of the disks, therein reducing strain and wear. Where wear does occur, its effect tends to be negligible, because the wear does not bore out the axis of rotation. The top disk is attached to the bottom disk with one axial longitudinal pin. The pin can be a bolt and nut, or any conventional fastening means. The back of the chair is hingedly attached to the seat using sectional elements, coupling elements and a tie bar. This hinged attachment, like the swivelable means, highly resistant to corrosion or clogging with sand. Neither the swivel nor the hinged attachment requires a lubricant to work properly. Nor does either produces black filings as the surfaces side across each other. There are no metals to rust or affect corrosion of a proximal metal. The only problem with this chair, from a marketing stand point, is that like diamond, it will last forever and never needs to be replaced.

BRIEF DESCRIPTION OF THE INVENTION

FIG. 1 is a perspective view of the preferred illustrated embodiment of the invention. The numbering convention is as follows. The first digit refers to a major component. The second place of a two digit number refers to a member of the major component. If there is need for even further definition, a two digit number and a small alphabetic letter is used.

Figure 8:
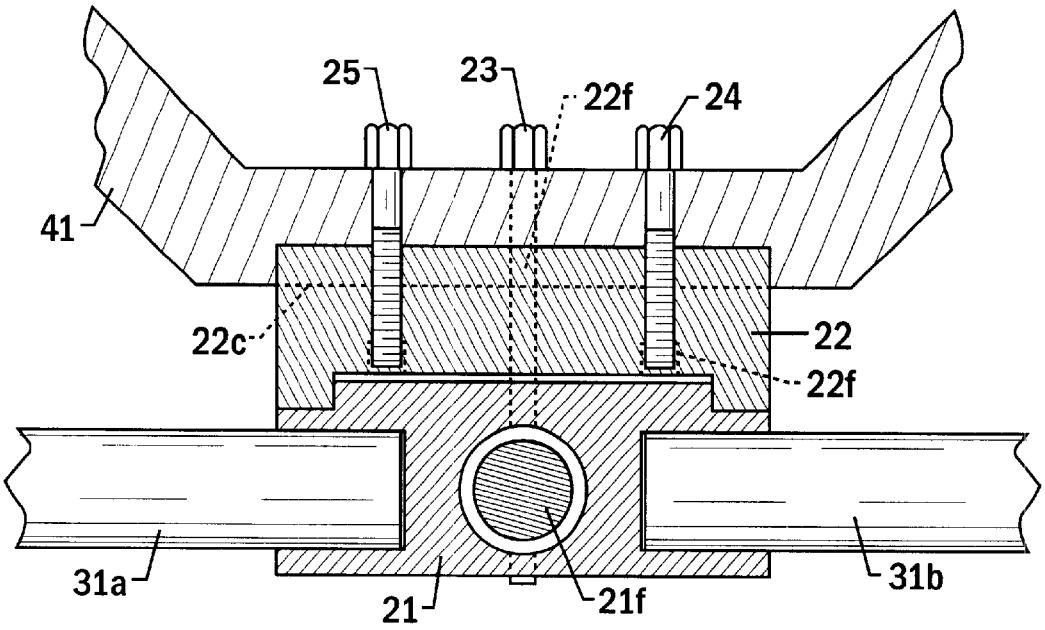

FIG. 8 is a magnified view of the planar bearing, which shows how all the components fit together. The hole for an axial longitudinal bolt is shown in ghost. Mounting bolts for fastening the underpinning to the planar bearing are shown as in ghost.

Figure 9:
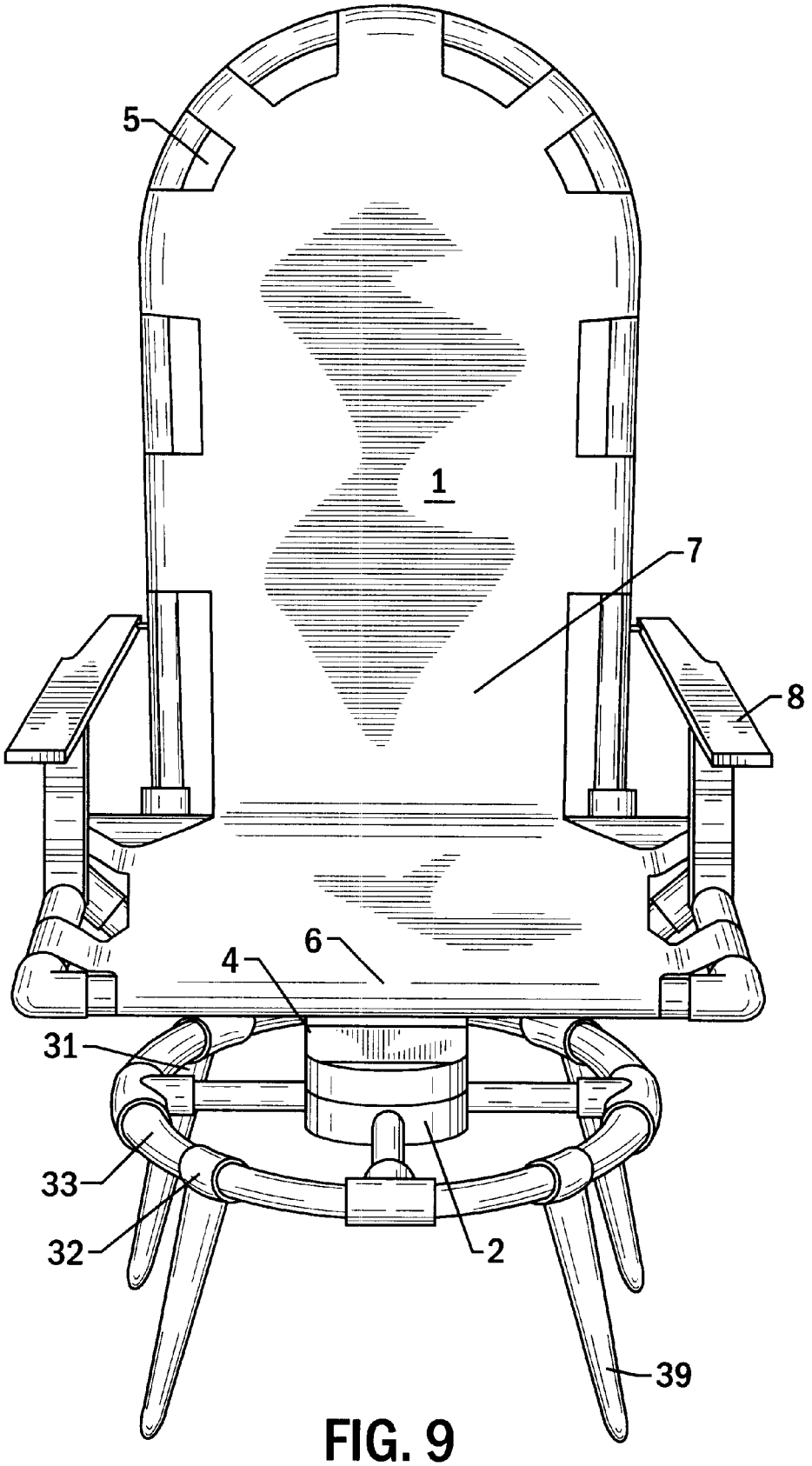

FIG. 9 is a modified version of the preferred illustrated embodiment showing that the invention can be easily modified to provide higher seating on a solid surface, where a solid surface is a floor. Traditional legs have been added to the base.

DETAILED DESCRIPTION OF ILLUSTRATED EMBODIMENT

Figure 1:
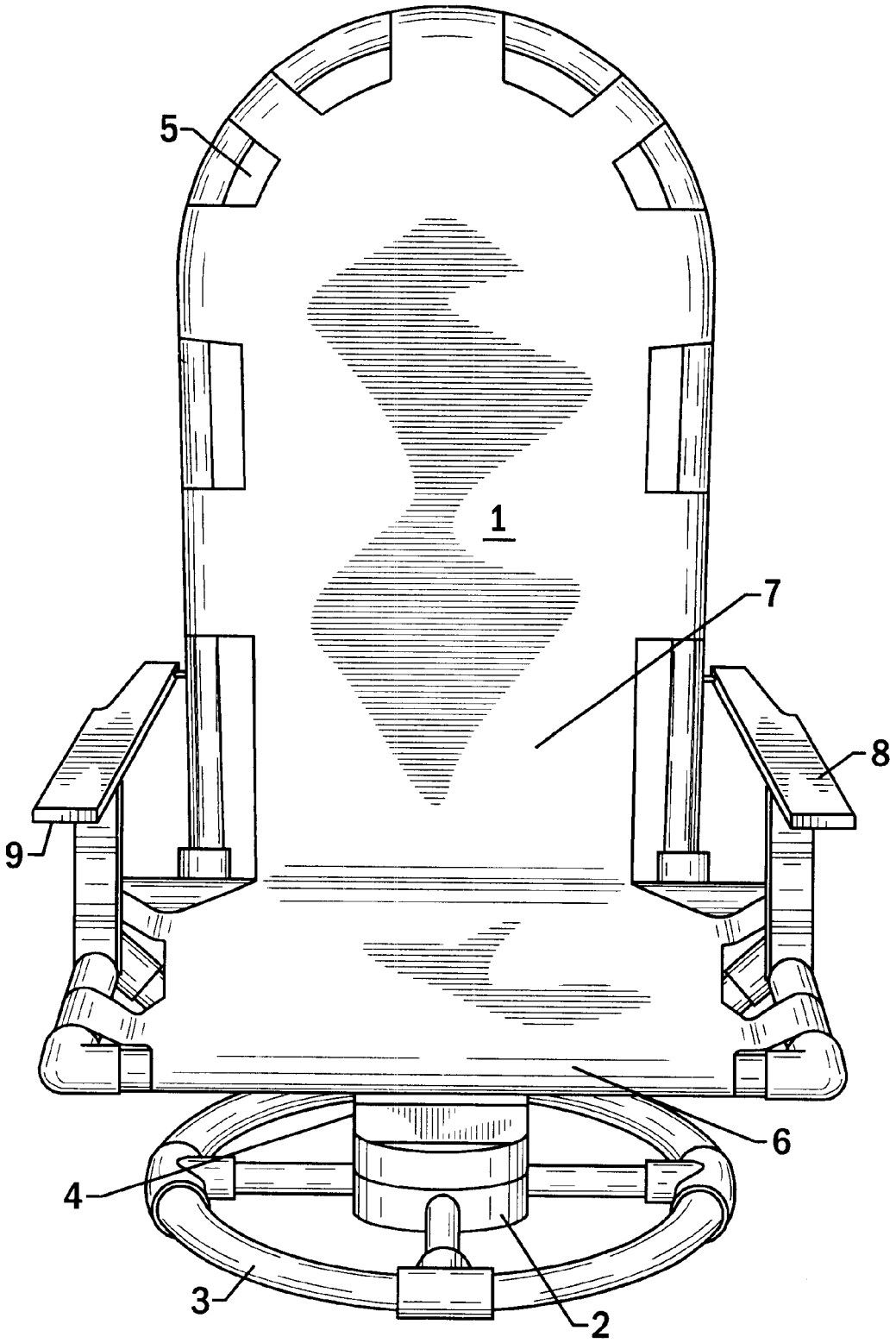
Figure 2:
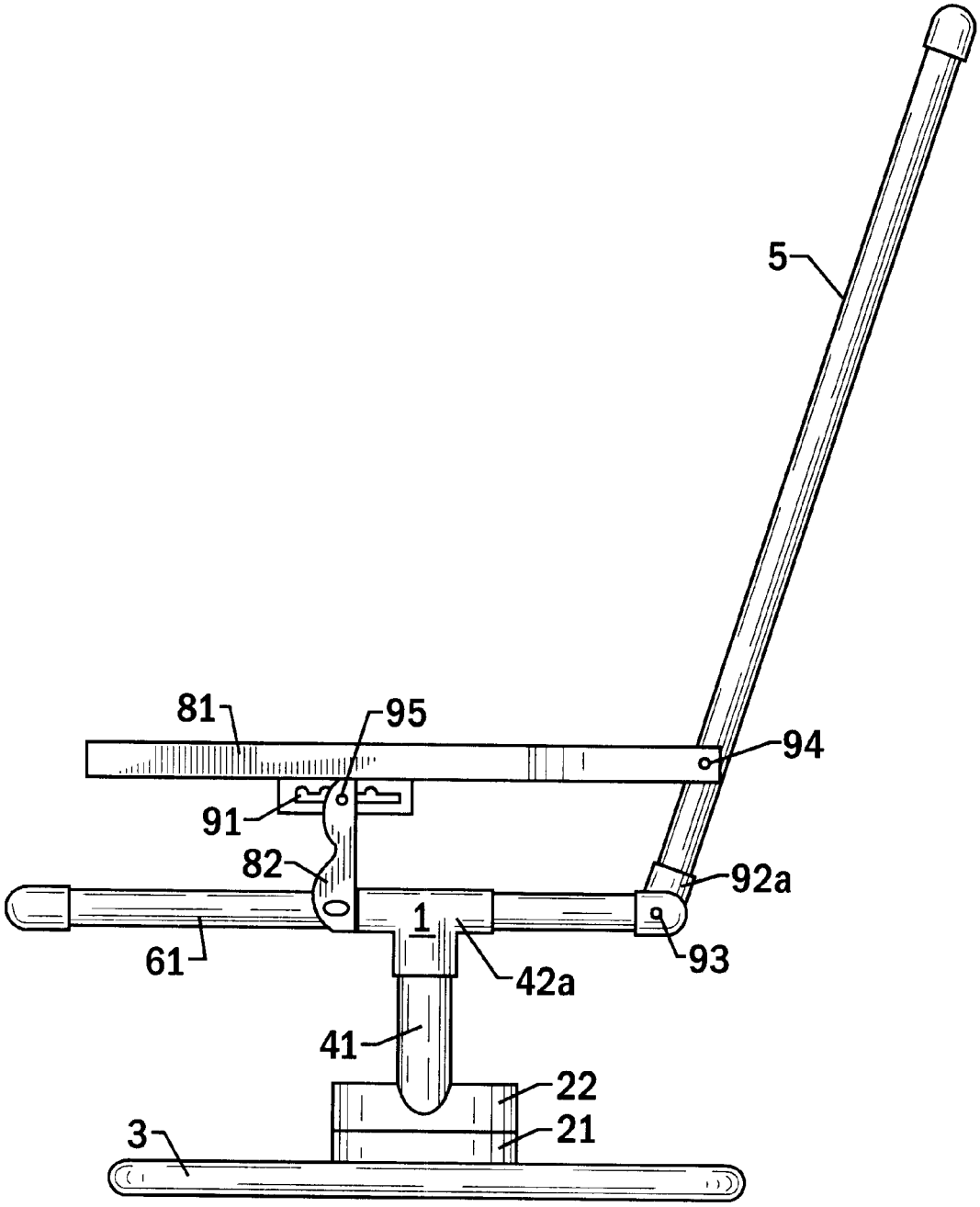
FIG. 2 is a side view of the invention, without a flexible covering on the frame.
Figure 3:
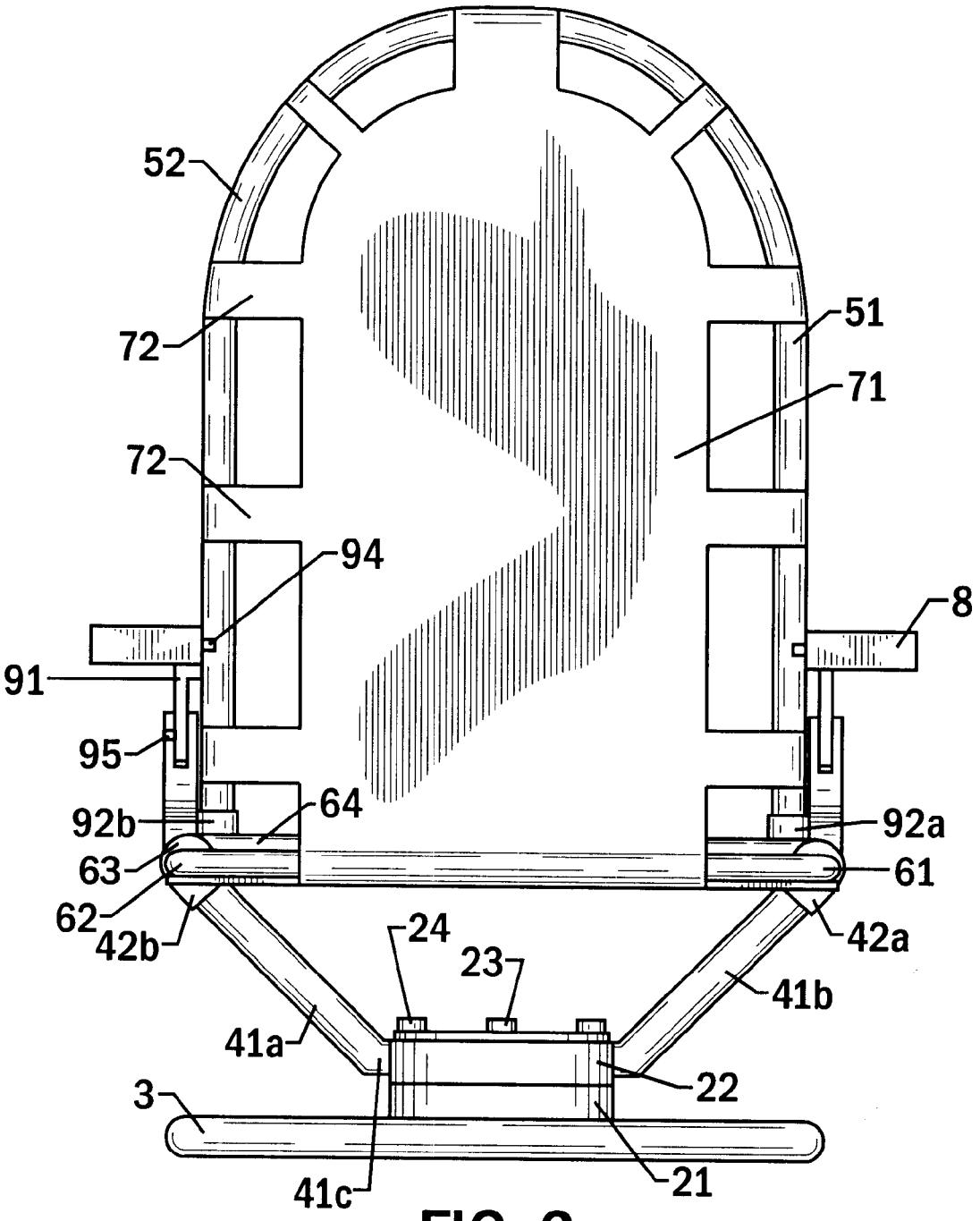
FIG. 3 is a frontal view of the preferred illustrated embodiment, where the illustration is designed to emphasize the swivelable means, where the swivelable means is a planar bearing.

The invention is the chair 1 shown in FIG. 1, where the chair is designed to be used on the beach. The chair 1 consists of the seat 6, the underpinning 4, the swivelable means 2, and the base 3. The preferred embodiment has a back 5, an armrest 8 and an adjustable recline feature 9. Referring to FIG. 2 and FIG. 3, the seat 6 is a frame which is fitted with a flexible covering 7 of a weather resistant heavy denier cloth 71 whose perimeter has short pieces of a webbing. The webbing is sewn into tabbed loops 72. The frame is constructed of sectional elements and extending, cornering or split coupling elements. Split coupling elements enable three sectional elements to be connected at one juncture. Examples include T shapes and Y shapes. The preferred sectional and coupling elements are pvc tubing. The frame of the seat has a front section element 61, a left sectional element 61, a right sectional element 63 and a rear sectional element 64. Cornering coupling elements are used to fashion substantially a rectangular frame. A corrosion resistant hinge for attaching the back 5 is created as follows. The rear sectional element 64, is fitted with a T-shaped coupling element (slightly hollowed) on both ends, and an interior tie rod 93, as shown in FIG. 2 is used to draw the elements together. The pvc tubing is not glued, allowing both the right T shaped coupling elements 92*a* and the left 92*b* to rotate freely. The back 5 is constructed of a sectional element having subsections labeled on the right as 51 and on the left as 52. Subsection 51 is fastened to 92*a* and subsection 52 is fastened to 92*b*. The chair has a left and a right armrest 8. The armrests are used in tandem to actuate the adjustable recline feature 9. The mechanics are more easily understood by referring to FIG. 2. The armrest 81 is hingedly attached to the back at 94. A Nylon washer assures easily movement without generation of any filings. A vertical support member 81, shaped like a tuning fork, has a locking pin 95, see FIG. 3. The bottom of the armrest is has a slotted piece of L shaped aluminum 91, wherein the selection of a slot sets an angle of recline.

The seat is supported by an underpinning 4, which connects the swiveling means 2 to the seat 6. Referring to FIG. 3, there is a heavy duty sectional element 41 that has a straight portion 41*c*, and two curved portions 41*a* an 41*b*. The straight portion 41*c* is mounted to the swiveling means 2, and the curved portion 41*a* is plugged into 42*a*, which is a T-shaped coupling element. On the opposing side of the frame, 41*b* is connected to 42*b*. Coupling element 42*a* is spliced into the left sectional element 61 of the frame of the seat 6. The opposing side is connected similarly. Coupling element 42*b* is spliced into the sectional element 63.

Figure 4:
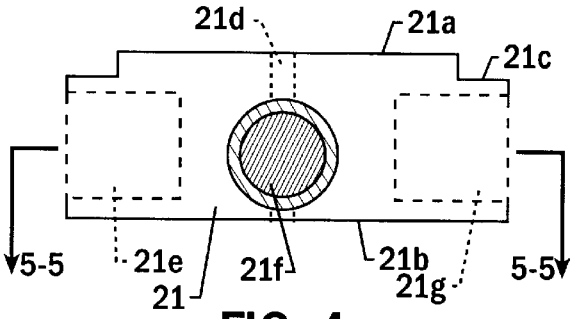
FIG. 4 is a side view of the bottom disk of the planar bearing. Dashed lines indicate components shown in ghost.
Figure 5:
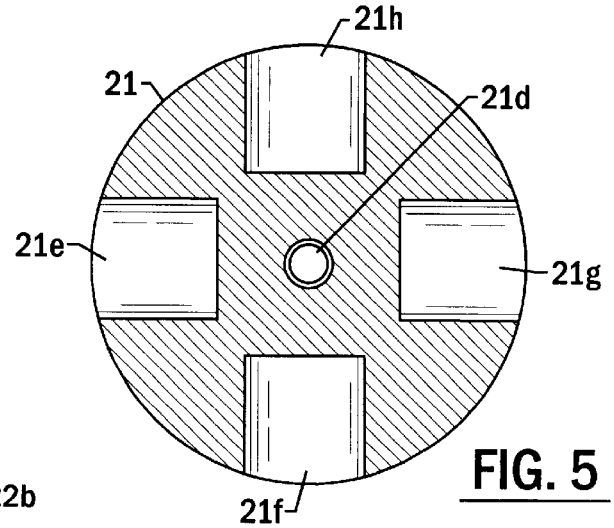
FIG. 5 is a cross-sectional view of the bottom disk, where the view is taken along sectional line 5—5.
Figure 6:
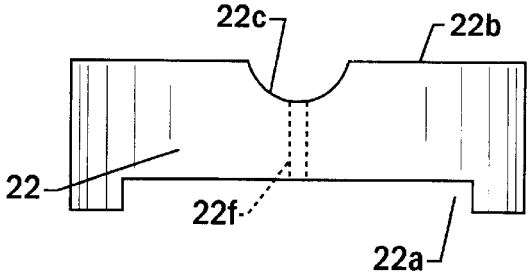
FIG. 6 is a side view of the top disk of the planar bearing. Dashed lines indicate components shown in ghost.
Figure 7:
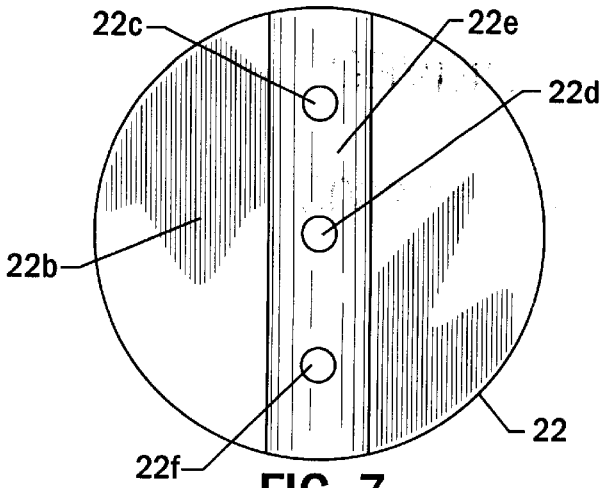
FIG. 7 is an overhead view of the top disk of the planar bearing.

The swivelable means is a planar bearing and hardware for connecting to the underpinning 4 and the base 3. Referring to FIG. 3, the planar bearing 2 is comprised of two disks, an upper disks 22, and a lower disk 21. The disks are substantially comprised of a tough polyamide, like Nylon®. Referring to FIG. 6 and FIG. 7. The top disk 22 has a diameter of approximately 8 inches and a thickness of approximately 2 inches. The upper face 22*b* has a shallow channel 22*c* cut across it, where the width of the channel is just large enough to accept the straight portion 41 of the underpinning 4. In the center of the disk there is an axial bore 22*d* that is cut through the thickness of the disk 22. The axial bore is ¾ inches wide and 2 inches deep. Also in the channel 22*c* there are two other holes 22*f* and 22*e* cut through the top disk. These latter holes are countersunk on the lower face 22*a*. As can be seen in FIG. 8, the purposes of countersinking the holes is to provide room for the head of the bolt, so that it does not protrude beyond the plane of the lower face of the top disk The lower face 22*f* is overcut. The overcut is circular and co-axial to the axial bore 22*d* and the rim of the top disk 22. The upper face 21*a* of the bottom disk 21 is undercut a complementary about. The net effect, as seen in FIG. 8, is that the top disk 22 is self centering on the bottom disk 21. Referring to FIG. 4, the bottom disk 21 has four identical holes 21*e–h,* for inserting four sectional elements 31*a–d*. Referring to FIG. 9, the sectional elements 31 are mounted radially on the bottom disk, and the outer end of the sectional element 31 is capped with a T-shaped coupling element 32. Each T-shaped coupling element 32 is connected to two curved sectional elements 33. The combination of sectional elements, coupling elements and curved sectional elements forms a ring with connecting spokes. This is the base 3.

FIG. 8 is shows how all the elements of the base 3, the planar bearing 2 and the underpinning 4 fit together. There is only one bolt 23 holding the top disk 22 to the bottom disk 21. That bolt 23, which is shown in ghost, goes through the straight portion 41 of underpinning 4, to the lower surface of the bottom disk 21. The other two bolts 25 and 24 reinforce the attachment to the top disk.

The base can be fitted with legs 39 as shown in FIG. 9 for applications where it is advantageous to have raised seating on firm ground.

What is claimed is:

1. A chair comprised of:

a seat;

an underpinning, which is fastened to and supports the seat;

a planar bearing, which is fastened to and supports the underpinning;

a base, which is fastened to and supports the planar bearing;

wherein said planar bearing is substantially constructed of plastic and is comprised of a pair of superimposed horizontal disks which are fastened together with an axial longitudinal pin;

where said pair of disks is comprised of an upper disk and a lower disk, where said upper disk has a bottom, overcut face that has a low friction first surface and a top face that is fitted with hardware for mounting the underpinning, and where said lower disk has an upper, undercut face that has a low friction second surface and a sectional portion that is equipped for mounting the base;

wherein the first surface of the upper disk fits flush against the second surface of the lower disk; and whereas said upper disk, which is affixed to the underpinning, can freely rotate on the lower disk, which is stationary and is affixed to the base which holds the chair upright.

2. The chair as claimed 1 where said seat is a frame covered with a flexible covering, where the frame is constructed of tubing, and where said flexible covering is a weather resistant cloth, where a perimeter of said cloth is attached with webbing which secures the cloth to the frame.

3. The chair as claimed in claim 2, wherein said seat has a back, and where the back has a back frame covered with a flexible covering, where said back frame is constructed of tubing, and where said flexible covering is a weather resistant cloth, where a perimeter of said cloth is attached with webbing which secures the cloth to the back frame.

4. The chair as claimed in claim 3 wherein the tubing is polyvinyl chloride tubing, commonly know as PVC tubing.

5. The chair as claimed in claim 4, where said polyvinyl chloride tubing has a diameter of at least one inch.

6. The chair as claimed in claim 3, wherein said chair has at least one armrest, where the armrest is fastened to the back frame and to the frame of the seat.

7. The chair as claimed in claim 6 wherein said armrest actuates an adjustable recline feature, where the adjustable recline feature enables the back to be reversibly adjusted backward, where said adjustable recline feature is comprised of a notched slide on the underside of the armrest, a pair of T shaped coupling elements connecting to a sectional element of the back frame and fitting over a pair of sectional elements of the frame, and a tie rod; where the notched slide locks in an angle of recline, where the T shaped coupling elements enable the back to hingedly move relative to the seat, and where the tie rod annularly secures the T shaped coupling elements to the pair of sectional elements of the frame.

8. The chair as claimed in claim 1, wherein said underpinning is comprised of at least one sectional element of tubing having a center straight section and a bent section on either side of the center straight section, where, when mounted, the bent section angles upward such that a first end is attached to a right side of the frame of the seat with a right T shaped coupling element, and a second end is attached to the left side of the frame; with a left T shaped coupling element, and wherein the center straight section of the sectional element is attached to the top face of the upper disk, and where the longitudinal pin passes through the center straight section of the sectional element through the upper disk and the lower disk.

9. The chair as claimed in claim 1 wherein the plastic of the planar bearing is constructed substantially of an engineering plastic having excellent corrosion resistance to strong sunlight, sand, salt water, and saltwater filled air; wherein said engineering plastic has low frictional resistance, such that it is self lubricating.

10. The chair as claimed in claimed 9, wherein said engineering plastic is comprised of a polyamide compounded with a lubricating substance.

11. The chair as claimed in claim 1, wherein the base is integral with the lower disk of said planar bearing therein forming a spoke-ring assembly, where the spoke-ring assembly is comprised of three to twelve sectional elements that are equidistantly seated in the lower disk and emanating radially, wherein each of the sectional elements are capped with a coupling element, where the coupling element is connected to two curved sectional elements, wherein said spoke-ring assembly provides a ring for the base.

12. The chair as claimed in claim 1, wherein said base has chair legs.

* * * * *